United States Patent [19]

Marteau d'Autry

[11] 4,362,063

[45] Dec. 7, 1982

[54] DEVICE FOR SAMPLING AND DISPENSING ADJUSTABLE VOLUMES OF LIQUID, WITH NUMERICAL DISPLAY

[76] Inventor: Eric Marteau d'Autry, 72, rue Gambetta, Villiers-le-Bel, France, 95

[21] Appl. No.: 221,397

[22] Filed: Dec. 30, 1980

[30] Foreign Application Priority Data

Jan. 4, 1980 [FR] France ..... 80 00130

[51] Int. Cl.[3] ..... B01L 3/02

[52] U.S. Cl. ..... 73/864.1; 73/864.18

[58] Field of Search ..... 422/100; 73/864.13, 73/864.18

[56] References Cited

U.S. PATENT DOCUMENTS 3,827,305 8/1974 Gilson ..... 73/864.18

4,250,755 2/1981 Kenney ..... 73/864.13

*Primary Examiner*—S. Clement Swisher

*Attorney, Agent, or Firm*—Mason, Kolehmainen, Rathburn & Wyss

[57] ABSTRACT

A device for sampling and dispensing adjustable volumes of liquid samples, with numerical display, is provided with a compact adjusting and display mechanism which comprises: an externally threaded sleeve which screw threadedly engages with the device housing; a prismatic control rod whose profile ensures that it rotates with the sleeve; a bush equipped, removably, with a means of causing it to rotate with the control rod; and a plurality of volume-indicator drums mounted around said bush. The sleeve serves as an adjustable end stop for a reciprocable piston actuated by the control rod.

10 Claims, 2 Drawing Figures

DEVICE FOR SAMPLING AND DISPENSING ADJUSTABLE VOLUMES OF LIQUID, WITH NUMERICAL DISPLAY

BACKGROUND OF THE INVENTION

The present invention relates to a device for sampling and dispensing adjustable volumes of liquid samples, with numerical display.

In general, the invention therefore applies both to micro-pipettes equipped at their lower end with sampling cones or to positive-displacement pipettes and to all other sampling and dispensing devices such as, for example, diluting devices.

Devices of this type, of the prior art, have the disadvantage of comprising housings of too great a length. This excessive axial dimension of the housings is necessitated by the very design of the adjusting and display mechanisms according to the prior art, for example illustrated by French Pat. No. 2203680, also U.S. Pat. No. 3,827,305. It should be noted that such a disadvantage becomes particularly annoying in the handling of so-called "positive-displacement" pipettes, that is to say those having, in addition, in their lower part a calibrated capillary tube of a certain length in which a tight-fitting piston moves.

In general, it would clearly be more convenient to have available such dispensing and sampling instruments having a shorter length. This would make it possible, in fact, either to handle them better in the laboratory or to accommodate them more easily within more sophisticated appliances such as automatic diluting devices.

The object of the present invention is therefore completely to modify the design of such adjusting and display mechanisms, so as to enable their axial dimensions to be limited.

SUMMARY OF THE INVENTION

According to the present inventions, such an adjusting and display mechanism comprises:

an externally threaded sleeve which is capable of cooperating by screw action with an internal thread of the housing and whose lower end constitutes the adjustable stop limiting the travel of the piston;

a prismatic control rod which passes through said sleeve and whose profile ensures that the rod is solid with the sleeve for rotation, while permitting relative sliding of said rod in relation to said sleeve;

a bush mounted to rotate freely in the upper part of the housing, coaxial with the sleeve, and equipped, removably, with means for rendering it solid with the control rod for rotation;

a plurality of volume-indicator drums mounted around said bush in such a way that the units drum is solid with the bush for rotation, the other freely rotating drums being equipped with drive means capable of controlling the relative movement of the drums in dependence on the movement of the bush, the sleeve and the control rod, all rotating together as a unit.

According to another characteristic feature of the present invention, the sleeve is capable of penetrating substantially completely into the housing.

According to another characteristic feature of the present invention, the diameter of the inner opening of the bush is of a size to enable the sleeve to penetrate into the bush.

Other characteristic features and advantages of the present invention will appear from a reading of the following detailed description with reference to the accompanying drawings.

DETAILED DESCRIPTION OF THE PREFERRED EMBODIMENT

Figure 2:
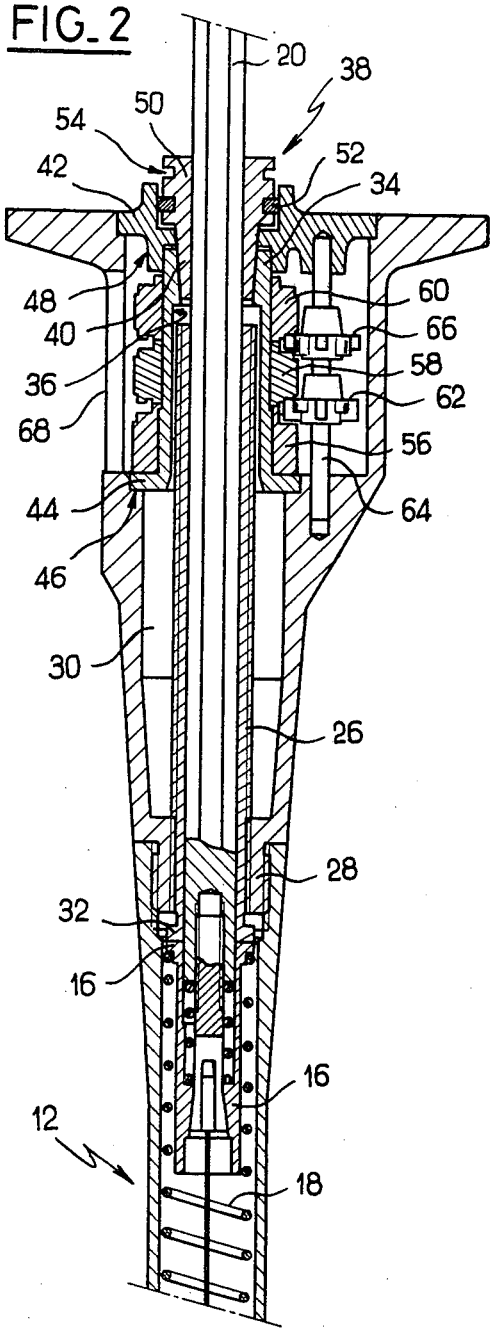
FIG. 2 illustrates, on a larger scale, a view in section of a detail of the adjusting and display mechanism according to the present invention.
Figure 1:
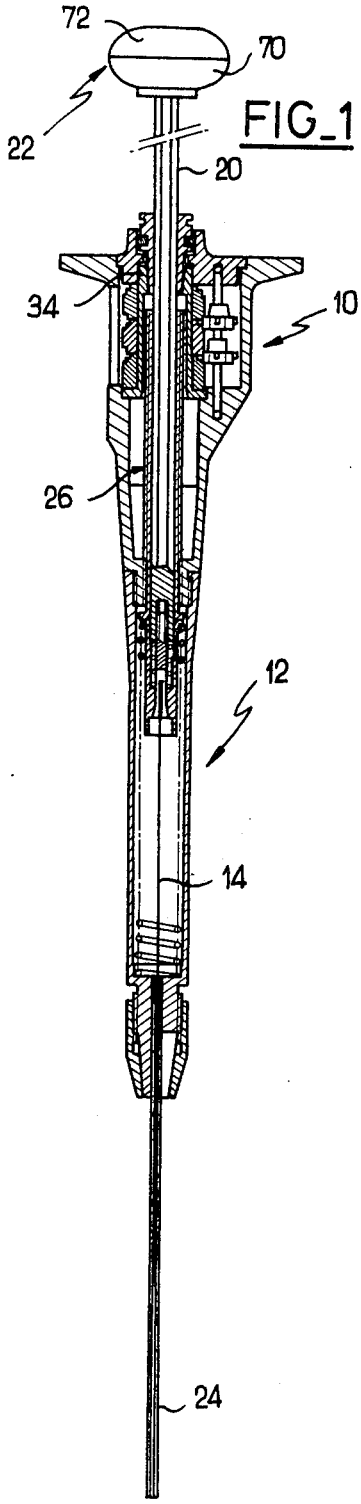
FIG. 1 is a view in section of the device for sampling and dispensing adjustable volumes of liquid samples equipping, according to the invention, a particular type of pipette.

The pipette illustrated by way of non-limiting example in FIG. 1 is of the so-called "positive-displacement" type. Such a pipette comprises conventionally an upper housing 10 solid with a substantially tubular lower body 12 which is removably equipped at its lower end with a calibrated capillary tube 24 in which a tight fitting piston 14 moves, being controlled in its movement by a control rod 20. In such devices the capillary tube 24 is preferably constituted by a glass tube calibrated in diameter, but not in length. The piston 14 has at least one region at which it fits tightly in the tube 24. This piston can, for example, be made advantageously in the form of a stainless steel wire having, in the case of a rod of small diameter, a coating, for example of Teflon. In the case of wires of a larger diameter, it will be necessary, for example, to place at the lower end of the piston a bead of Teflon which comes into close contact with the inner surface of the capillary tube 24. The length of such a piston 14 is not made to an exact manufacturing tolerance. It will be noted, however, that the length of this piston must be greater than the length of the capillary tube 24, this being necessary to permit both its operation and the zero setting of the pipette. The construction details of such a positive-displacement pipette are, for example, described in a more detailed manner in the Applicant's French Pat. No. 2446672.

In the embodiment illustrated in the accompanying drawings, the stop which limtis the upward travel of the piston is the stop limiting the travel of the element gripping the piston 14. This upper stop is, of course, vertically adjustable, so as to enable the effective travel of the sampling and dispensing piston to be modified by adjusting the position of this upper stop. The stop limiting the downward travel remains, on the other hand, fixed.

It is perfectly clear that the special volume-display and adjusting mechanism which is the subject of the present invention need not be limited to the special case of a positive-displacement pipette. On the contrary, the present invention is applicable, in a quite general way, to a mechanism for adjusting the adjustable position of a travel-limiting stop belonging to any type of sampling and dispensing device whatever.

Such devices conventionally comprise an upper housing 10 solid with a substantially cylindrical lower body 12 in which a piston 14 moves reciprocatingly and is urged resiliently to come in contact with an adjustable upper stop for limiting the travel of the piston. In the embodiment illustrated, it is the gripping element 16 which is urged upwards resiliently due to the spring 18 and which is controlled in its movement simultaneously with the piston 14 by means of a control rod 20 passing through the housing 10. The upper end of the rod 20 is provided with a pushbutton 22. The actual adjusting and display mechanism includes a sleeve 26 threaded over its entire outer part, thus enabling it to cooperate by screw action with a corresponding thread cut directly in the inner wall of the housing 10. In the particular embodiment illustrated, a constricted region 28 of the housing or an insert or nut made solid with said housing ensures the screw engagement. In this particular case, it will be observed that it is the free lower surface of the lower end of the threaded sleeve 26 which constitutes the adjustable stop for limiting the travel of the sampling and dispensing piston 14.

According to the present invention, the sleeve 26 is capable of penetrating substantially completely into the cavity 30 of the housing 10. In the embodiment described, it will be observed that the lower part of the sleeve 26 which constitutes the variable-position stop has a radial peripheral projection 32 which is intended to limit the extent to which the sleeve 26 can be screwed into the inside of the cavity 30 of the housing 10. In the drawings the sleeve 26 is illustrated in a position near its upper extreme position.

The mechanism according to the invention includes, moreover, the control rod 20 which is prismatic and passes entirely through the sleeve 26 and whose special profile ensures that the rod 20 is solid with the sleeve 26 for rotation, while, nevertheless, permitting a free relative sliding of the rod 20 in relation to the sleeve 26. In the particular embodiment illustrated, the control rod 20 has a hexagonal cross-section and the threaded sleeve 26 has a matching passage cross-section. It is perfectly clear that the particular cross-section of the control rod 20 can assume any other polygonal, rectilinear or curvilinear form or else other more irregular forms. The important characteristic of the rod/sleeve unit is the close interaction between these two elements, so that a rotation of the control rod 20 always causes a rotation of the sleeve 26, while permitting their free relative sliding.

The mechanism according to the invention includes, furthermore, a bush 34 which is mounted to rotate freely in the upper part of the housing 10, coaxial with the sleeve 26 and the control rod 20. It will now be seen that, when the pipette is assembled, after the sleeve 26 has been screwed into the inside of the cavity 30 of the housing 10, the bush 34 is put in place in the upper part of the housing 10 and, at that time, the bush 34 remains totally independent of any rotation of the rod 20 and/or of the sleeve 26.

According to an important characteristic of the present invention, it should be noted that the diameter 36 of the inner opening of the bush 34 must be selected so as to enable the sleeve 26 to penetrate inside the said bush 34. This characteristic makes it possible to reduce the length of the cavity 30 of the housing 10 intended to receive the whole of the adjusting display mechanism, while permitting a considerable effective adjustment travel. Moreover, the bush 34 is equipped, removably, with a means of making it solid with the control rod 20 for rotation. In the particular embodiment illustrated, this interlocking means is constituted by a revolving part 38 which has an inner opening of a form matching the outer profile of the control rod 20, so as to enable it to be solid with said control rod for rotation. Furthermore, the lower end of the interlocking part 38 terminates in a conical part 40 intended to enable it to become wedged in the upper part of the bush 34. Such wedging thus makes it possible for the bush 34 and the control rod 20 together to rotate as a unit. This special arrangement will make it possible, notably, to effect a zero setting of the pipette, for example when said pipette is assembled at the factory.

The opening of the upper part of the housing 10 is advantageously sealed by a snap-on cover 42 which simultaneously ensures that the bush 34 and the various volume-indicator drums described in more detail below are kept in position. The bush 34 illustrated in the accompanying drawings has in its lower part a radial projection 44 which is intended to interact with a matching offset step 46 provided on the inner wall of the housing 10. When the pipette is assembled, it will be noted that it is sufficient to install the bush 34 whose correct positioning is facilitated by the presence of this projection 44 interacting with the factory at the time of assembly or, as the case may be, at an inspection, it is then possible to work advantageously in the following manner. The sleeve 26 is screwed completely downwards until the end of the effective travel of the piston 14 is reached. It will be observed that, at that time the bush 34 still remains freely rotatable in relation to the control rod 20 and in relation to the sleeve 26. This enables the volume-indicator drums to be placed in their zero display position while the piston 14 is at the end of its effective travel. Then, after snapping on the cover 42, the interlocking part 38 is introduced, and its conical lower part 40 wedges the upper part of the bush 34 against a collar 48 provided on the lower part of the cover 42 of the pipette. The zero setting is thus effected very easily yet very accurately. It will be noted that the interlocking part 38 has, in the vicinity of its upper part, a ring 50 which is provided with a peripheral groove intended to receive a friction ring 52 which, by interacting with the matching part of the cover 42, ensures that the adjusting mechanism is immobilised in the position selected by the user. In practice, it will be possible, for example, to use a four-lobe gasket to ensure this locking function. Advantageously, such a braking ring 52 will be made of an elastically deformable flexible material which resists wear and tear. For this purpose, for example, a braking ring made of a material selected from fluorocarbon resins, polychloroprene and, preferably, polyurethanes will be used.

The upper part of the interlocking part 38 has a sort of ring provided with a peripheral groove 54, a recess or else a projection intended to provide a gripping zone, to enable said interlocking part 38 to be extracted from the bush 34. On the assumption that this operation of removing the adjusting and display mechanism from the pipette needs, in principle, to be carried out at the factory only, these gripping zones will be accessible only with great difficulty, indeed not at all, from the outside of the housing 10 and will preferably require the use of a specially shaped key intended to permit the extraction of this part only by a qualified member of staff.

The mechanism which makes it possible to effect the display of the sample volume chosen by the user also includes a plurality of volume-indicator drums. These volume-indicator drums, for example, the units drum 56, the tens drum 58 and the hundreds drum 60, are mounted around said bush 34 so as to be stacked one on the other. It will be noted that the above-mentioned radial projection 44 also makes it possible to prevent downward slipping and to position exactly the first units-indicator drum 56. It is appropriate to note that this first units drum must be solid with the bush 34 for rotation. This interlocking can be obtained, for example by wedging, by glueing or by any other suitable means. In contrast, the other drums (the tens 58 and the hundreds 60) remain totally free to rotate around the bush 34. However, these drums are, of course, connected to drive means which are capable of controlling their relative movement in dependence on the movement of the bush 34, the movement of the sleeve 26 and the movement of the control rod 20, all these rotating together as a unit, as seen above, when the pipette is fully assembled.

In the particular embodiment illustrated, the drums indicate the settings of volumes in units, tens and hundreds of microlitres respectively. It is perfectly possible to provide more or fewer drums, graduated in any unit desired. The movement of the drums in relation to one another is effected in a conventional way. For a complete rotation of the units drum 56, only one pair of teeth drives a sprocket wheel 62 mounted on a spindle 64 which penetrates into the snap-on cover 42. The sprocket wheel 62 drives continuous gears on the tens drum 58 to displace it by one-tenth of a revolution. Likewise, a complete rotation of the tens drum 58 causes a unitary movement of the hundreds drum 60 by means of the action of a single pair of gear teeth, an additional sprocket wheel 66 and a continuous gear on the hundreds drum 60.

It will also be noted that the housing 10 of the pipette has, in the conventional manner, a transparent window 68 enabling the indicator drums to be read.

According to another characteristic of the present invention, the pushbutton 22 is made in two independent parts. Only the lower part 70 causes the control rod 20 to rotate. The unifying for rotation of the lower part 70 of the pushbutton 22 can be obtained by any suitable means, for example by giving the opening passing through this lower part 70 of the button 22 a form matching the outer profile of the control rod 20. In contrast, the upper part 72 of the pushbutton remains totally free to rotate both in relation to the control rod 20 and in relation to the lower part 70 of the pushbutton 22. Such an arrangement has the advantage of preventing any risk of maladjustment of the pipette during the use of the pipette. The operator thus applies a pressure to the upper part 72, and only to this upper part, of the button 22 with his thumb. With a button as a single unit, it could happen, at the time of a thrust on the rod 20, mainly during the ejection stroke, that the thumb applies to the upper part of the button a certain force which tends to cause this to turn slightly. With the special construction of the push-button, in two independent parts, there is, therefore, no longer any risk of maladjustment during use. This can be decisive in the case of series of measurements, in which the operator seeks to take several strictly indentical samples in succession.

The present invention is not, of course, limited to the particular embodiments described, but it is perfectly possible to conceive a certain number of variations in detail without thereby departing from the scope of the invention.

I claim:

1. A device for sampling and dispensing adjustable volumes of liquid samples, comprising an upper housing, a substantially cylindrical lower body secured to the upper housing, piston means movable reciprocatingly in the lower body, adjustable stop means limiting the travel of the piston means, means resiliently urging said piston means into contact with said adjustable stop means, a control rod which passes through the housing, and pushbutton means at the upper end of said control rod, wherein the improvement comprises a mechanism to adjust the position of said stop and to display the corresponding sample volume, said mechanism comprising:

an externally threaded sleeve which is capable of cooperating by screw action with an internal thread of the housing and whose lower end constitutes said adjustable stop, said control rod comprising a prismatic control rod and passing through said sleeve and having a profile such that said rod rotates with the sleeve, while permitting a relative sliding of said rod in relation to said sleeve;

a bush mounted to rotate freely in the upper part of the housing, and coaxial with the sleeve;

means for causing said bush to rotate with the control rod, said means removably securing said bush to said rod;

said bush including an inner opening with a diameter of a size to enable said sleeve to penetrate into said bush, a plurality of volume-indicator drums surrounding said bush in such a way that the units drum rotates with the bush, the other freely rotating drums being equipped with drive means capable of controlling the relative movement of the drums in dependence on the movement of the bush, the sleeve and the control rod rotating as a unit.

2. Device as claimed in claim 1, wherein the sleeve is capable of penetrating substantially completely into the housing.

3. Device as claimed in claim 1, wherein the sleeve has, in the vicinity of its lower end, a radial projection which limits the depth to which said sleeve can be screwed into said housing.

4. Device as claimed in claim 1, wherein an opening of the upper part of the housing is sealed by a cover which ensures that the bush and the volume-indicator drums are kept in position.

5. Device as claimed in claim 1, wherein the means for causing the bush to rotate with the control rod are constituted by a part which has an inner opening of a form matching the outer profile of the control rod and whose lower end terminates in a conical part which is capable of wedging in the upper part of the bush.

6. Device as claimed in claim 5, wherein said interlocking part has in its upper part a ring which is provided with an outer groove intended to receive a friction ring interacting with the matching part of the cover.

7. Device as claimed in claim 6, wherein said ring has, in the vicinity of its upper part, gripping means which are intended to enable the interlocking part to be extracted from the bush.

8. Device as claimed in claim 1, wherein the length of the sleeve is calculated so as to penetrate as deeply as possible into the bush.

9. Device as claimed in claim 1, wherein the lower part of the bush has a radial projection which is intended to interact with a matching offset step provided in the inner wall of the housing.

10. Device as claimed in claim 1, wherein said pushbutton means comprises two substantially equal parts, the lower part rotating with said control rod and the upper part remaining free to rotate in relation to said lower part and in relation to said control rod.

* * * * *